United States Patent [19]

Castro, Jr.

[11] Patent Number: 4,930,393

[45] Date of Patent: Jun. 5, 1990

[54] MODEL ROCKET LAUNCH SYSTEM

[76] Inventor: Walter N. Castro, Jr., 104 Lake Pines, Irvine, Calif. 92720

[21] Appl. No.: 180,131

[22] Filed: Apr. 11, 1988

[51] Int. Cl.[5] ..... F41F 3/04

[52] U.S. Cl. ..... 89/1.814; 102/206; 446/429

[58] Field of Search ..... 102/206, 217, 200, 347; 446/56, 429; 89/1.814

[56] References Cited

U.S. PATENT DOCUMENTS

| | | | |
|---|---|---|---|
| 2,421,893 | 6/1947 | Lambert et al. | 89/1.814 |
| 2,515,051 | 7/1950 | Lloyd | 89/1.814 |
| 3,662,685 | 5/1972 | Lurey | 102/347 |
| 3,736,836 | 6/1973 | McAllister | 89/1.814 |
| 3,748,955 | 7/1973 | Gatermann et al. | 89/1.814 |
| 3,916,759 | 11/1975 | Jones et al. | 89/1.814 |
| 4,632,031 | 12/1986 | Jarrott et al. | 102/200 |

OTHER PUBLICATIONS

Lionel, "Playthings", vol. 56, No. 3, Mar. 1958 p. 228.

*Primary Examiner*—Charles T. Jordan
*Assistant Examiner*—Michael J. Carone
*Attorney, Agent, or Firm*—Lyon & Lyon

[57] ABSTRACT

A model rocket launch controller system which can operate in an automatic or manual mode. Selection between the two modes is determined by a double pole double throw switch. When the controller is placed in the auto mode, power is supplied to an electrical timer which counts down from a user selected time until the zero or ignition time. At such time the power is directed to an igniter circuit. An LCD display shows the remaining until ignition. A flasher circuit is provided to drive an LED to indicate the auto mode has been selected. In the manual mode, power is supplied directly to the igniter circuit when a single pole/push button switch is activated. An LED is also provided to indicate mode has been selected.

6 Claims, 1 Drawing Sheet

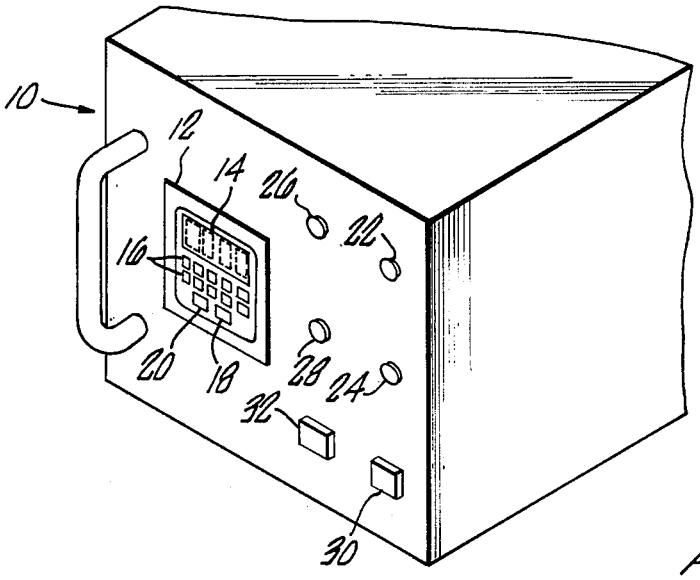
FIG. 1.
FIG. 2.
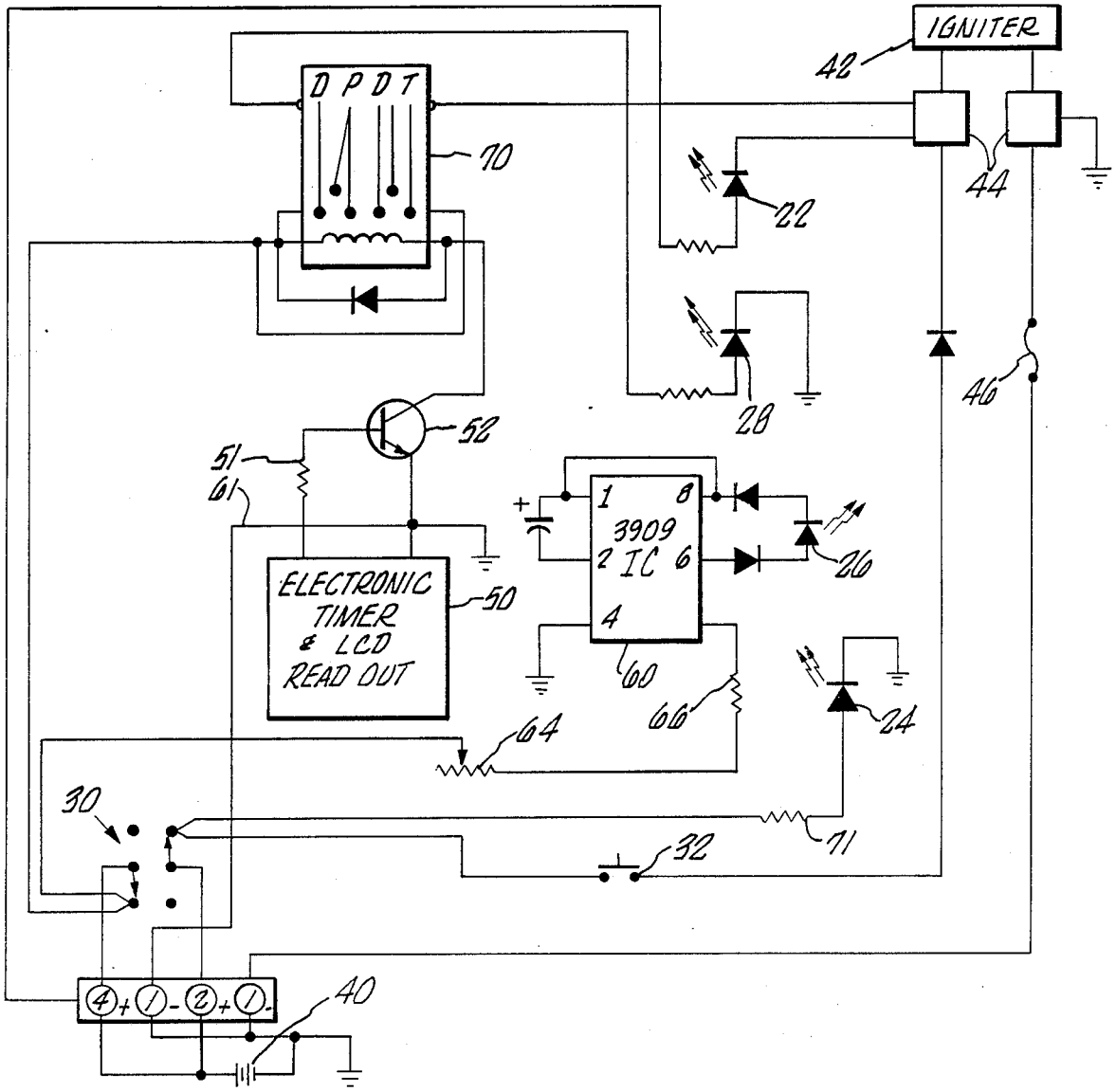

MODEL ROCKET LAUNCH SYSTEM

BACKGROUND OF THE INVENTION

Interest in space and rocketry was generated by the launching of sputnik, the world's first satellite, by the Soviet Union in 1957. This was the year the Space Age was born as well as the hobby of model rocketry. Interest in rockets continued to grow with America's Mercury rocket program followed by the Apollo missions and the shuttle launches. Model rocketry is miniature astronautics. It brings the size, weight and complexity of rockets down to a level that an individual can understand and therefore share in the experience and wonder of rocketry. Participation in this hobby has helped hobbyists learn more about Newton Laws of Motion, electronics, ballistics, gravitation, aerodynamics, meteorology and optics. A greater understanding of the mathematical theories inherent in these technologies have been learned by the hobbyist over the years as well as a greater understanding of space flight.

Model rocketry has brown into an international aerospace sport with international competition rules established by the Federation Aeronautique Internationale (FAI) of Paris, France. As a result of man's continued fascination with rockets and space flight, the hobby has spread worldwide to countries such as Canada, Yugoslavia, Czechoslovakia, Bulgaria, East and West Germany, Poland, England, France and the Soviet Union. It is a sport which unites persons of all countries who share in the wonder of space flight.

Model rocketry has evolved into one of the safest of all hobbies. The Safety Code is written in 1957 which established a set of common sense rules which are voluntarily followed by model rocket hobbyists. Adherence to these rules is meant to ensure the hobbyists' own safety and the safety of spectators.

The Safety Code mandates that an electrical launch control system be used by the hobbyist. Model rockets must be ignited electrically for accurate and precise ignition of solid propellants. This accuracy cannot be achieved with a fuse launch system. In the prior art, the launch controller's components included: a battery, a continuity light, a switch, a safety interlock key, 10 feet of wire and clips for connecting the wires to the engine igniter. The launch controller was first connected to a battery and the clips were connected to the igniter. The safety interlock key was then inserted to arm the launcher. At this time, the continuity light illuminated, indicating that there was a continuous circuit through the controller and the igniter. When the launch switch was pressed, the lamp was cut out of the circuit and the full voltage of the battery was applied to the igniter.

SUMMARY OF THE INVENTION

A computerized model rocket launch controller system is disclosed herein which more realistically simulates the launch of an actual rocket. The controller of the invention can operate in one of two modes, the auto mode or manual mode. When the controller is placed in the auto mode, power is supplied to an electrical timer which counts down from a user selected time until the zero or ignition time. An LCD display shows the time remaining until ignition. A flasher circuit is provided to drive a red light emitting diode (LED) to flash an indication that the auto mode has been selected. At the time of ignition, the circuit between the power supply and the igniter circuit is completed. When the controller is operated in the manual mode, the circuit is manually completed by closing a single pole/push button switch. An LED is provided to indicate that the manual mode has been selected. Selection between the auto mode and the manual mode is determined by the position of a double pole double throw switch. A safety fuse may be provided in the igniter circuit for safety of operation.

Accordingly, one purpose of my invention is to provide a computerized launch controller for use in connection with model rocket launch system.

A further object of my invention is to more closely approximate the launch of a full size rocket in the model rocketry arena.

A further object is to provide a model rocket launcher capable of operating in the auto mode or the manual mode.

Yet a further object of this invention is to provide a model rocket launcher which complies with the safety code observed by model rocketry hobbyists.

These and other objects and features of the invention will be apparent from the following detailed description, by way of example, with reference to the drawings in which:

FIG. 1 illustrates the preferred embodiment of the face plate of the controller; and FIG. 2 is a schematic circuit diagram of the launcher circuitry.

DETAILED DESCRIPTION OF THE PREFERRED EMBODIMENT

FIG. 1 shows a top view of the outer housing 10 of the controller in the preferred embodiment. The timer 12 has a display 14 which may be either a liquid crystal display or an LED display. The user may select the length of count-down time by entering the time by buttons 16. Countdown of the timer is activated by depressing the start button 18. A stop/reset button 20 is provided to stop the countdown or to provide for resetting of the time until countdown.

A variety of LEDs may be provided to indicate the status of the controller. In the preferred embodiment, a yellow LED 22 indicates continuity, i.e., that a continuous electrical circuit exists between the output terminals to the igniter. Two red LEDs are provided to indicate whether the controller is operating in the manual mode or auto mode, the "manual armed" LED 24 or "timer armed" LED 26 will be respectively lit to indicate the status. A green "ignition" LED 28 may be provided to indicate that power has been provided to the igniter.

A double pole double throw switch 30 is provided to select between the manual launch and auto launch modes. A single pole push button switch 32 is provided to activate the igniter in the manual mode.

FIG. 2 shows the preferred embodiment of the computerized launch circuitry. Power is supplied by a twelve volt DC battery 40, shown in schematic form. The computerized launch circuit will serve to connect the battery 40 to the igniter 42 through the output terminals 44. A current limiting fuse 46 is provided for safety. In the preferred embodiment, a 2½ amp fuse is used.

In the auto mode, the double pole double switch 30 is selected such that power from the battery 40 is supplied to the electronic timer and LCD readout 50. The electronic timer 50 is readily available from any number of sources, and any number of them may be used which meet the purposes and objectives of this invention. Line 61 supplies power to the emitter of switching transistor 52. The switching transistor may be of the type designated 2N3904. Line 61 is also connected to the negative input of the electronic timer 50. The positive connection of the electronic timer 50 is connected through a dropping resistor 51 to the base of the switching transistor 52. When the switching transistor 52 is on, the collector lead of the switching transistor completes the circuit from the battery 42 to the double pole double throw relay 70. When the timer 50 reaches its designated set point, the current flow through the transistor 52 opens the circuit to operate the relay 70. After the relay 70 is activated, current travels from the relay 70 to the output terminals 44, and through safety fuse 46 to the igniter 42.

When in the auto mode, the "timer armed" LED 26 will flash. A timer chip or flasher chip 60 is used to drive the LED 26. The chip 60 is preferably of the type designated 3909. A variable 10K dropping resistor 64 and a fixed dropping resistor of 300 ohms 66 are interposed between the power supply 40 and the positive input of the chip 60. The rapidity of the flashing of the flasher circuit may be selected by varying the capacitance connected to the chip 60.

In the manual mode, the double pole double switch 30 is placed in the manual mode. In this mode, activation is achieved by depressing the single pole push button switch 32, thereby completing the circuit between the battery 40 and the igniter 42. The red "manual armed" LED 24 may be driven from the battery 40 through a dropping resistor 71. In the preferred embodiment, this resistor has a value of 560 ohms.

The yellow "continuity" LED 22 is connected in series from the battery 40 through a dropping resistor 74, preferably of 560 ohms, through the LED 22, from the output terminal 44 through the igniter 42 and back to ground of the negative output terminal 44. This light will indicate that continuity between the battery and igniter exists.

Though the invention has been described with respect to a specific preferred embodiment thereof, many variations and modifications will become apparent to those skilled in the art. It is therefore the intention that the appended claims be interpreted as broadly as possible in view of the prior art to include all such variation and modifications.

What is claimed is:

1. A model rocket launcher for providing power to an igniter for a model rocket comprising:
   - an outer housing,
   - a count down timer including a display on the outer housing to indicate the time to launch,
   - first and second terminals on the housing for providing power to an igniter for a model rocket,
   - a power source for the ignition power,
   - a selection switch for selection between operation in an auto mode and a manual mode,
   - an auto mode circuit including a relay, which relay is activated by the count down timer when the timer has counted down to zero, when selected the auto mode circuit connecting the power supply through the selection switch, through the relay to the first terminal,
   - a manual mode circuit including a manually operated switch, when selected the manual mode circuit connecting the power supply through the selection switch to the first terminal,
   - and a return circuit connecting the second terminal to the power source.

2. The model rocket launcher of claim 1 wherein the auto mode circuit further includes a flasher circuit which indicates when the auto mode circuit has been activated.

3. The model rocket launcher of claim 1 further comprising one or more status indicating lights on the housing.

4. The model rocket launcher of claim 3 wherein the status indicating lights are light emitting diodes.

5. The model rocket launcher of claim 1 wherein the selection switch is a double pole double throw switch.

6. The model rocket launcher of claim 1 wherein the time display is a liquid crystal display.

* * * * *